US008231738B2

(12) United States Patent
Haeberle

(10) Patent No.: US 8,231,738 B2
(45) Date of Patent: Jul. 31, 2012

(54) DISHWASHER TUB HAVING INTEGRAL HINGE SUPPORT MEMBER, AND DISHWASHER INCORPORATING SAME

(75) Inventor: Robert J. Haeberle, New Bern, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 332 days.

(21) Appl. No.: 12/124,236

(22) Filed: May 21, 2008

(65) Prior Publication Data

US 2009/0007944 A1 Jan. 8, 2009

Related U.S. Application Data

(60) Provisional application No. 60/947,458, filed on Jul. 2, 2007.

(51) Int. Cl.
*A47L 15/42* (2006.01)

(52) U.S. Cl. ..... 134/56 D; 134/57 D; 134/58 D; 134/201

(58) Field of Classification Search ..... 134/201, 134/56 D, 57 D, 57 DL, 58 D, 58 DL, 200; 312/321.5, 326
See application file for complete search history.

(56) References Cited

U.S. PATENT DOCUMENTS

| | | | | |
|---|---|---|---|---|
| 3,349,428 | A * | 10/1967 | Suska | 16/273 |
| 3,704,550 | A | 12/1972 | Hancock | |
| 3,921,252 | A | 11/1975 | Guth | |
| 4,359,250 | A * | 11/1982 | Jenkins | 312/228 |
| 4,940,298 | A | 7/1990 | Jackson et al. | |
| 5,613,747 | A | 3/1997 | Becker et al. | |
| 5,758,676 | A | 6/1998 | Duckwall et al. | |
| 5,794,309 | A | 8/1998 | Lotz | |
| 6,254,173 | B1 | 7/2001 | Friedewald et al. | |
| 6,764,147 | B2 | 7/2004 | Flowers | |
| 6,945,614 | B2 | 9/2005 | Flowers et al. | |
| 2004/0184897 | A1 * | 9/2004 | Levey et al. | 411/411 |
| 2005/0189837 | A1 * | 9/2005 | Lee | 310/217 |
| 2005/0285491 | A1 * | 12/2005 | Lee | 312/328 |
| 2007/0068561 | A1 | 3/2007 | Shin | |

FOREIGN PATENT DOCUMENTS

| | | |
|---|---|---|
| EP | 0 452 288 | 10/1991 |
| JP | 409 000485 | 1/1997 |
| JP | 2002 282189 | 10/2002 |

* cited by examiner

*Primary Examiner* — Michael Barr
*Assistant Examiner* — Benjamin Osterhout
(74) *Attorney, Agent, or Firm* — Alston & Bird LLP

(57) ABSTRACT

A dishwasher comprises a tub formed as a molded plastic structure having a bottom wall joined to a plurality of vertical walls, and a top wall joined to upper ends of the vertical walls, so as to define a wash chamber, a front side of the tub defining an opening for access to the wash chamber; (b) a door for closing the opening in the front side of the tub; (c) a hinge support member integrally molded with the tub and located proximate the front edge of the bottom wall of the tub; and (d) a pair of hinge plates respectively secured to the opposite side edges of the door and pivotally engaged with the hinge support member on the tub to enable the door to pivot relative to the tub about a horizontal pivot axis defined by the hinge support member.

8 Claims, 8 Drawing Sheets

DISHWASHER TUB HAVING INTEGRAL HINGE SUPPORT MEMBER, AND DISHWASHER INCORPORATING SAME

CROSS-REFERENCE TO RELATED APPLICATION

This application claims the benefit of the filing date of U.S. Provisional Patent Application Ser. No. 60/947,458 filed on Jul. 2, 2007, the disclosure of which is incorporated herein by reference.

BACKGROUND OF THE INVENTION

The present disclosure relates generally to automated dishwashers, and relates more particularly to arrangements for connecting a door to a dishwasher so that the door can pivot about a horizontal pivot axis.

An automated dishwasher typically has a molded plastic tub having an open front side that is closed by a door that pivots about a horizontal pivot axis located adjacent the lower edge of the door. Various mechanisms have been devised over the years for pivotally connecting the door to the fixed structure of the dishwasher. In most cases, a pair of hinge plates are affixed to the frame in which the tub is supported. Each hinge plate has a portion defining a generally circular aperture. Hinge pins are secured to opposite side edges of the door proximate its lower edge, and the hinge pins are engaged in the apertures so that the door can pivot about the pivot axis defined by the apertures. A drawback of this design is that the tub-to-frame tolerances and the frame-to-hinge plate tolerances, in terms of positioning of the door and its pivot axis, can be additive. This can lead to unacceptably large variability in the location of the door and its pivot axis relative to the tub, which can result in problems such as looseness or "wobble" of the door, as well as poor sealing between the door and the tub when the door is closed for washing.

BRIEF SUMMARY OF THE DISCLOSURE

The present disclosure concerns a dishwasher having an arrangement for connecting the door to the tub in a manner tending to improve the accuracy of positioning and orientation of the door and its pivot axis relative to the tub. In accordance with one aspect of the invention, a dishwasher comprises: (a) a tub comprising a molded plastic structure having a bottom wall joined to a plurality of vertical walls, and a top wall joined to upper ends of the vertical walls, so as to define a wash chamber, a front side of the tub defining an opening for access to the wash chamber, the bottom wall having a front edge; (b) a door for closing the opening in the front side of the tub, the door having a lower edge, two opposite side edges, and an upper edge; (c) a hinge support member integrally molded with the tub and located proximate the front edge of the bottom wall of the tub; and (d) a pair of hinge plates respectively secured to the opposite side edges of the door and pivotally engaged with the hinge support member on the tub to enable the door to pivot relative to the tub about a horizontal pivot axis defined by the hinge support member.

In one embodiment, the hinge support member defines a bore and the hinge plates are secured to the hinge support member by elongate members that are inserted into opposite ends of the bore. Alternatively, the hinge support member could define elongate members and the hinge plates could have bores for receiving them.

In accordance with one embodiment, the hinge support member comprises a pair of bosses integrally molded with the tub and respectively located proximate opposite ends of the front edge of the bottom wall. Each boss has a bore extending at least partially therethrough. The elongate member for one of the hinge plates is inserted into the bore in one of the bosses, and the elongate member for the other hinge plate is inserted into the bore in the other boss.

In one embodiment, each elongate member comprises a hinge screw that is screwed into the bore in the respective boss. Advantageously, the bores in the bosses are untapped prior to the hinge screws being screwed into the bores, and the hinge screws comprise self-tapping screws.

The dishwasher in accordance with one embodiment further includes a pair of leg members respectively secured to opposite side walls of the tub and extending downwardly from the tub for supporting the dishwasher on a support surface with the bottom wall of the tub spaced above the support surface. The leg members abut respective side faces of the bosses such that the bosses provide lateral support to the leg members. Each of the leg members defines an aperture through which the respective hinge screw extends.

The hinge plates can also include portions serving as counterbalance arms for the door. Each hinge plate defines an aperture through which the respective hinge screw extends, each leg member having a portion disposed between the respective boss and a portion of the respective hinge plate. Each hinge screw has an enlarged head that is adjacent a laterally outer surface of the respective hinge plate.

In one embodiment, the enlarged heads of the hinge screws are stepped, each defining a larger-diameter head portion and a smaller-diameter head portion. The larger-diameter head portions are adjacent the laterally outer surfaces of the hinge plates, and the smaller-diameter head portions pass through the apertures in the hinge plates and abut laterally outer surfaces of the leg members. The apertures in the hinge plates are slightly larger than the smaller-diameter head portions of the hinge screws, such that the hinge plates can freely pivot about the hinge screws.

The dishwasher and tub construction in accordance with the present disclosure avoids the previously described additive tolerances (i.e., tub-to-frame tolerances and frame-to-hinge plate tolerances) associated with the above-described conventional approach to connecting a door to a dishwasher. In accordance with the present disclosure, the door is essentially directly connected to the tub in a pivotal manner by virtue of the hinge support member. The hinge support member, being integrally molded with the tub, has precise dimensions and thus the pivot axis for the door is highly accurately located with respect to the tub. Additionally, the lateral positioning and vertical positioning of the door relative to the tub are established by the hinge support member or bosses in a highly accurate manner.

The present construction thus can substantially reduce the degrees of freedom of the hinge plates, and therefore of the door, thereby reducing door "wobble", improving the fit and sealing between the door and tub, and providing a higher-quality "feel" to the door's action.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
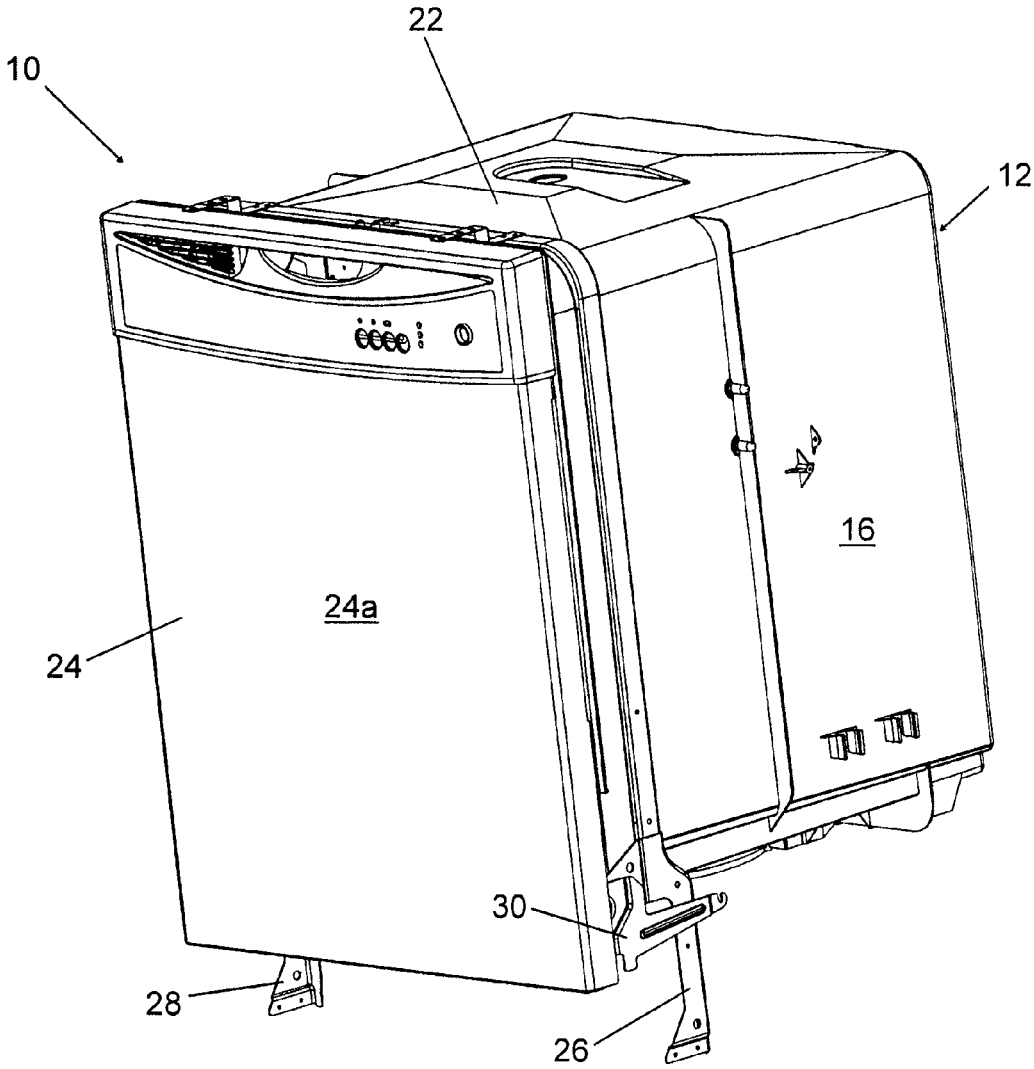
FIG. 1 is an isometric view of a dishwasher in accordance with one embodiment of the invention.
Figure 2:
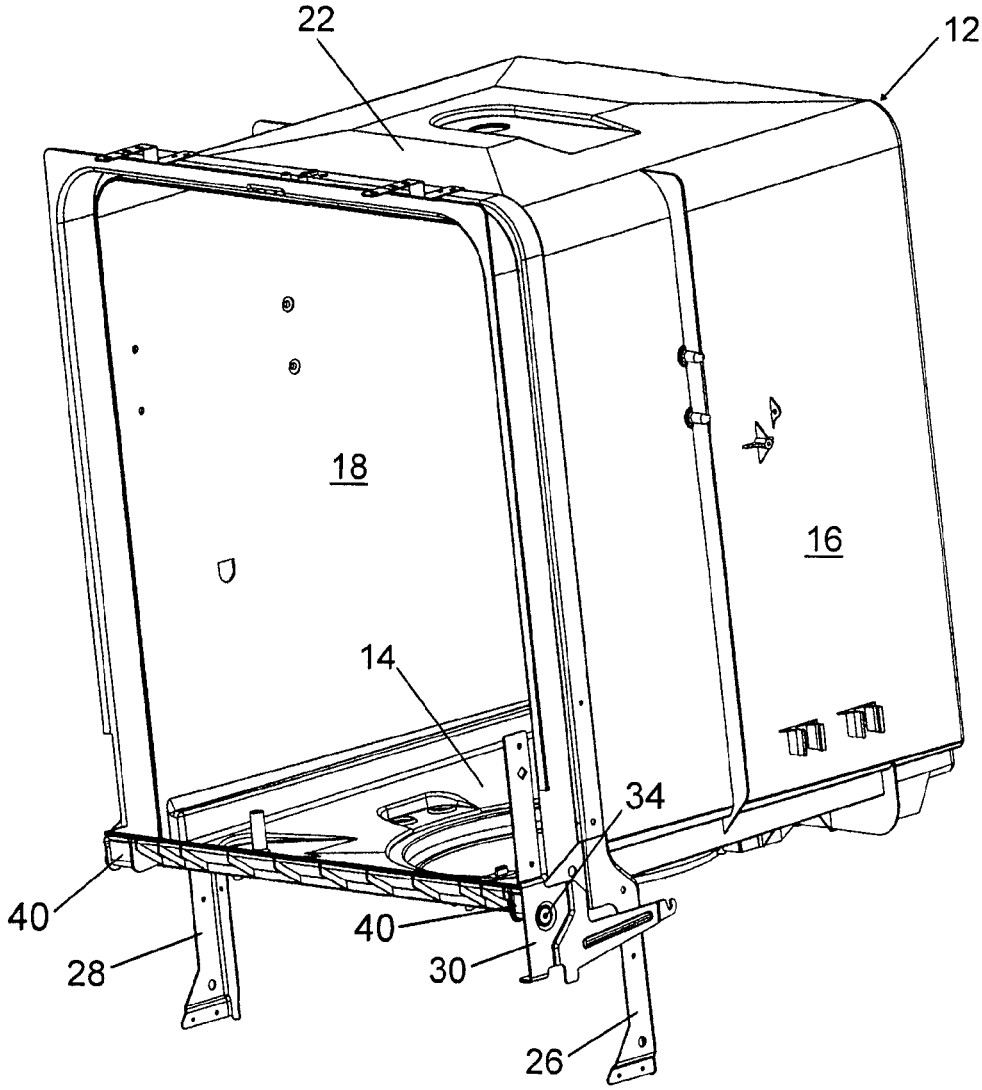
FIG. 2 is an isometric view of the dishwasher with the door removed.
Figure 3:
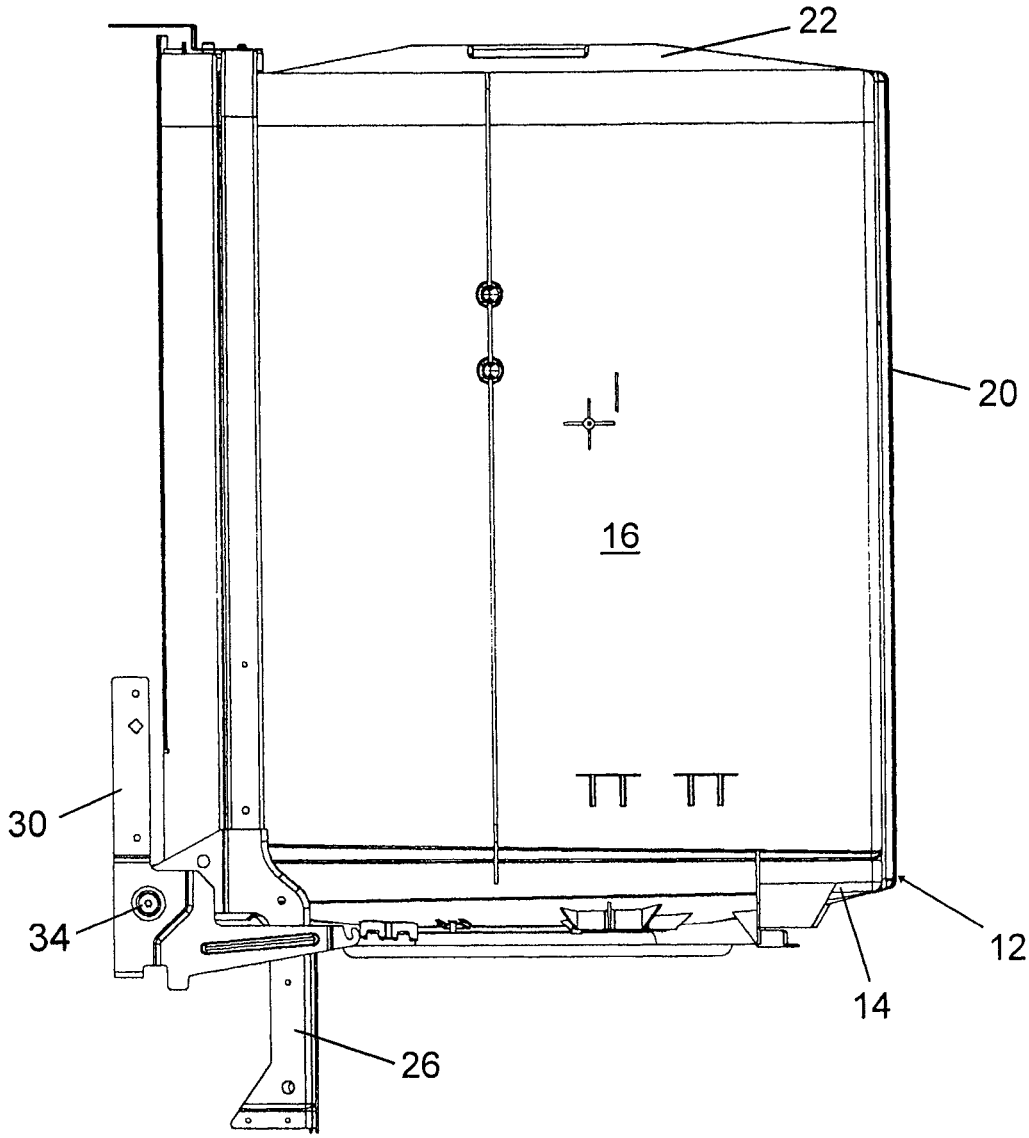
FIG. 3 is a side view of the dishwasher.
Figure 4:
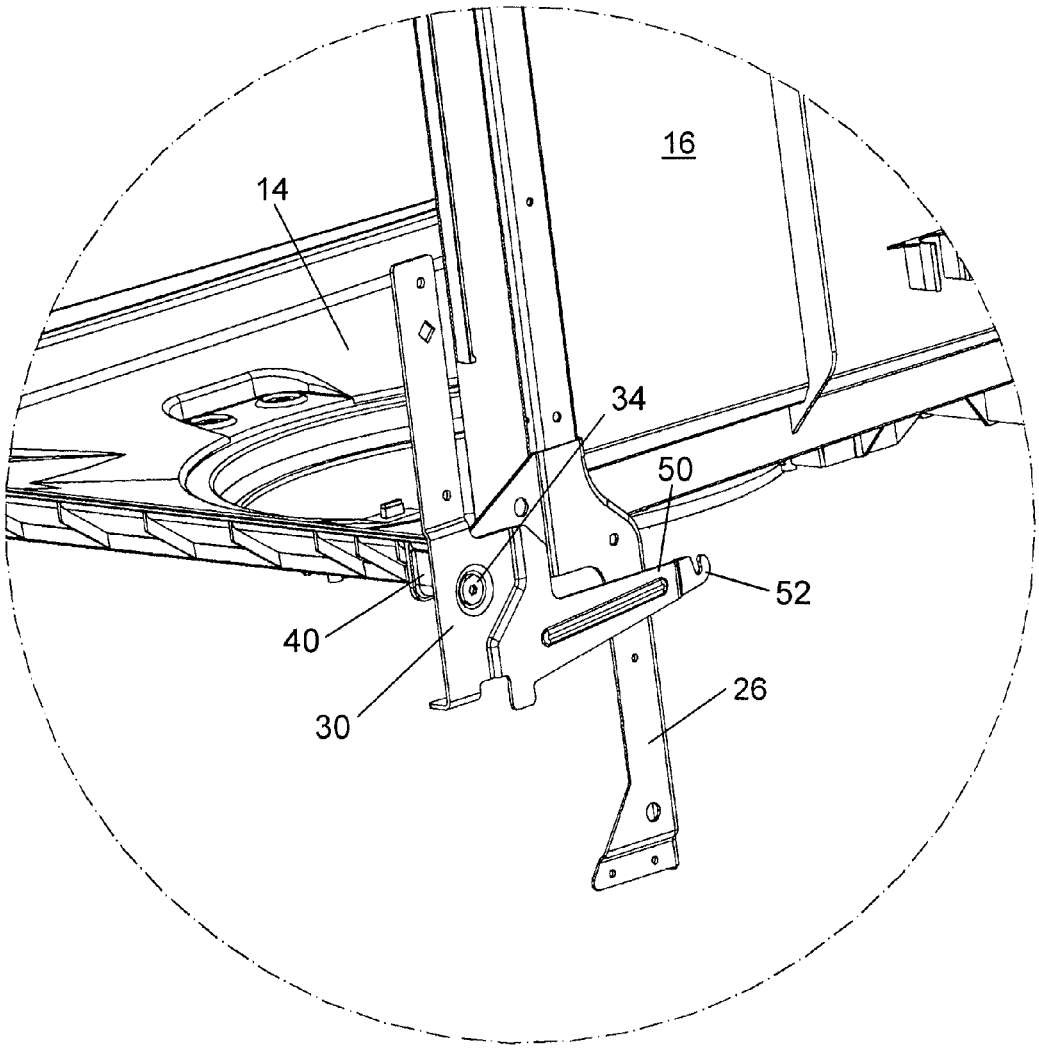
FIG. 4 is an isometric view of a portion of the dishwasher on an enlarged scale.
Figure 5:
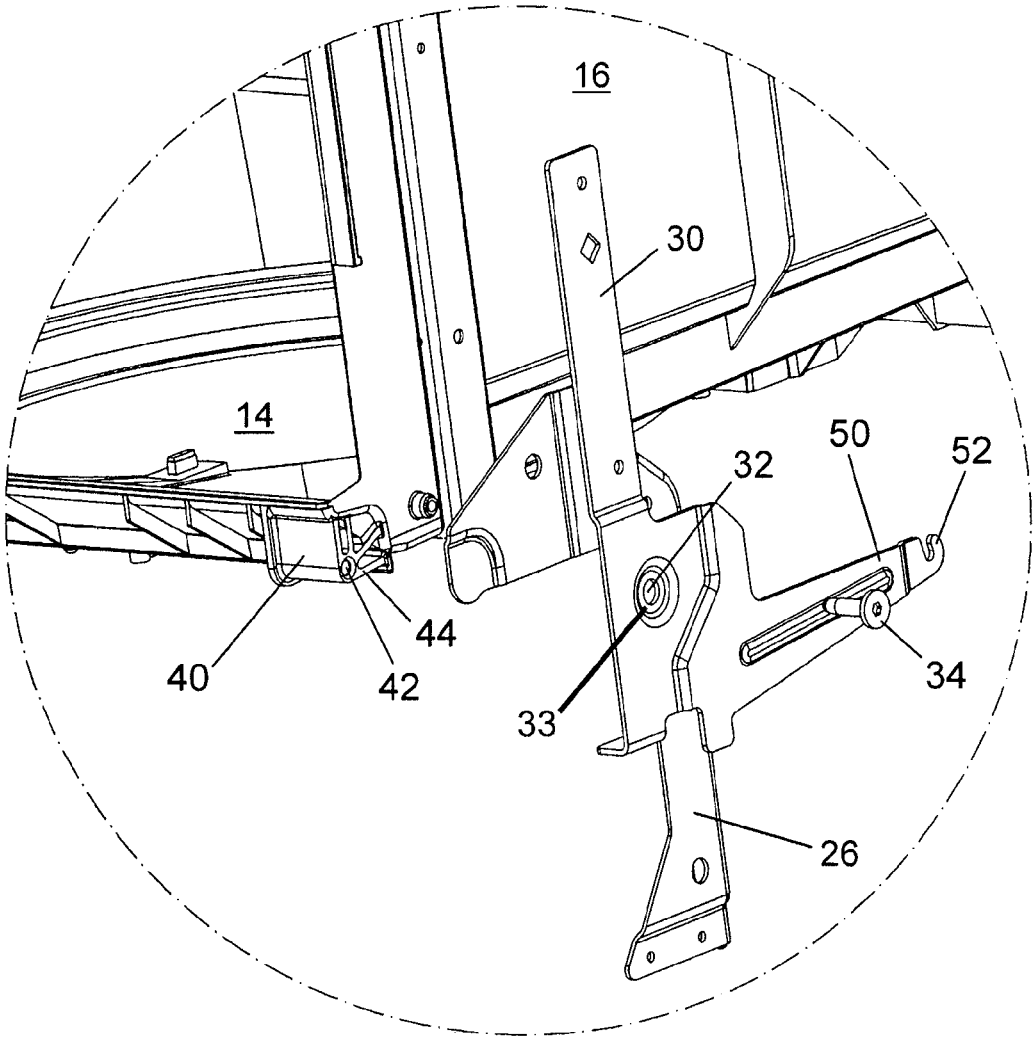
FIG. 5 is an exploded view of the portion of FIG. 4.

A dishwasher 10 in accordance with one embodiment of the invention is depicted in FIGS. 1-6. The dishwasher has a molded plastic tub 12 comprising a box structure as best seen in FIG. 2. The tub includes a bottom wall 14, opposite side walls 16 and 18, a rear wall 20 (FIG. 3), and a top wall 22. The side walls 16, 18 and rear wall 20 are joined to opposite side and rear edges, respectively, of the bottom wall and extend vertically upwardly therefrom; the top wall 22 is joined to upper ends of the side and rear walls. The side walls 16, 18 are parallel to each other, the bottom and top walls 14, 22 are parallel to each other and perpendicular to the side walls, and the rear wall 20 is perpendicular to the side, top, and bottom walls. Thus, the tub is configured generally as a hollow cuboid structure having five faces formed by the walls and being open on what would be the sixth face at the front side of the tub. In one embodiment, the entire tub as described above is a one-piece molded plastic structure. The open front side of the tub is closed for washing by a door 24 as shown in FIG. 1. The door is omitted in the other figures for clarity of illustration. The door 24 is pivotally connected to the fixed structure of the dishwasher such that the door pivots about a point located in the general vicinity of the lower edge of the door.

The fixed structure of the dishwasher includes the tub 12 as well as a frame typically formed of sheet-metal parts fastened together by welding and/or fasteners, and affixed to the tub using fasteners such as screws. The frame is largely omitted in the figures for clarity of illustration, but includes a pair of front leg members 26, 28 that are respectively secured to the opposite side walls 16, 18 of the tub adjacent its front side. The leg members extend downwardly from the tub for supporting the dishwasher on a support surface with the bottom wall 14 of the tub spaced above the support surface.

With reference to FIG. 1, the door 24 includes an inner door portion (not visible) and an outer door portion 24*a* that is connected to the inner door portion. A space is defined between the inner and outer door portions for accommodating various components as known in the art. The inner door portion is pivotally connected to the fixed structure of the dishwasher. With reference to FIGS. 2 through 6, affixed to each opposite side edge of the door 24 (and specifically, the inner door) is a hinge plate 30 (only one shown in the figures). The hinge plates can be formed from sheet metal and can be affixed to the door using suitable fasteners such as screws (not shown). Each hinge plate defines an aperture 32 (FIG. 5) for passage of a hinge screw 34 therethrough.

Figure 6:
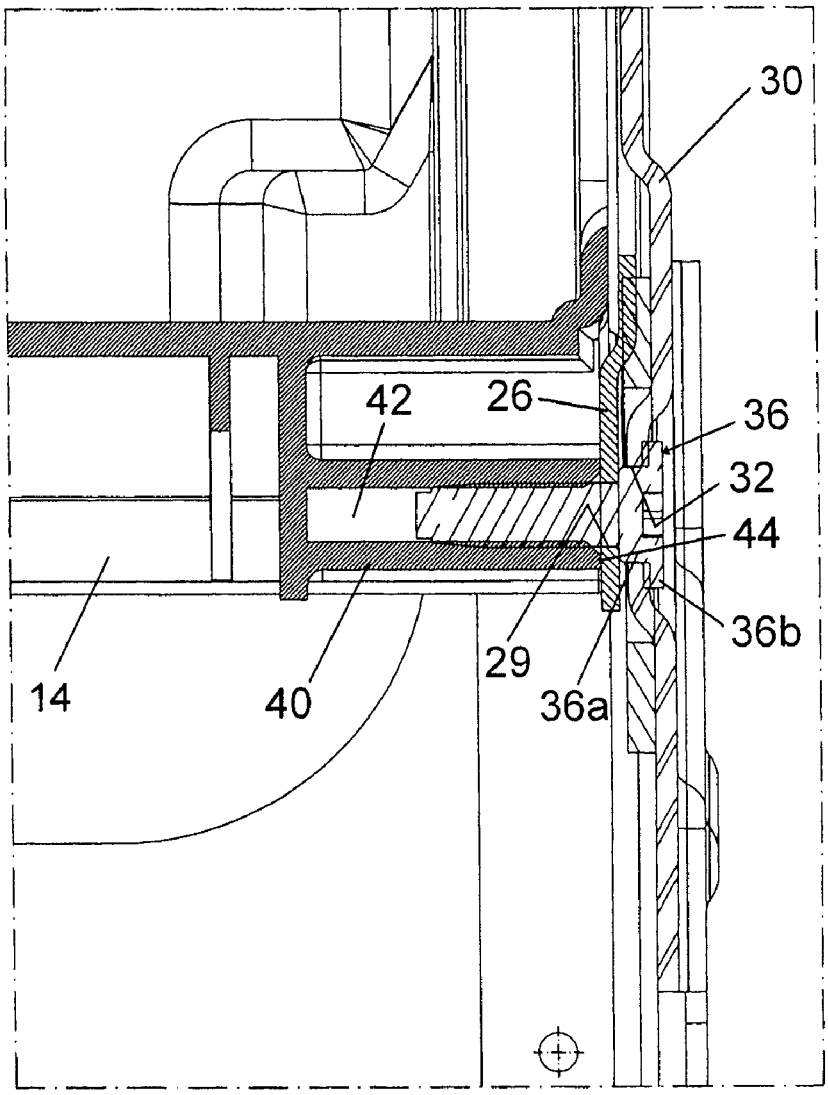
FIG. 6 is a cross-sectional view through one of the hinges of the dishwasher.

The dishwasher includes a hinge support member integrally molded with the bottom wall 14 of the tub 12, and the hinge plates 30 are affixed to the hinge support member in a manner allowing the hinge plates to pivot about a pivot axis defined by the hinge support member. In the illustrated embodiment, the integrally molded hinge support member comprises a pair of bosses 40 integrally molded with the front edge of the bottom wall 14 of the tub as best seen in FIG. 2, the bosses being respectively located proximate opposite ends of the front edge of the bottom wall. Of course, it would be possible to provide a single boss extending the entire length of the front edge of the bottom wall, but for reduction in material usage and cost it is preferable to make the hinge support member discontinuous as a pair of separate bosses. Each boss 40 defines a bore 42 (as best seen in FIG. 6) extending at least partially through the boss in a horizontal direction that is parallel to the front edge of the bottom wall of the tub. Because the bosses are integrally molded with the tub, the dimensional precision of the bore 42 and its location and directional orientation with respect to the tub can be highly precise.

Each hinge plate 30 is secured to its respective boss 40 by the hinge screw 34, which extends through the aperture 32 in the hinge plate and into the bore 42 in the boss. As noted, the tub and hence the boss is molded of a plastic material. The bore 42 in each boss advantageously is untapped. The hinge screws 34 advantageously comprise screws specially designed for screwing into untapped bores in plastic material, the screws being self-tapping screws that form threads in the bore when they are screwed into the bore. The hinge screws further advantageously have anti-loosening features that prevent the screws from loosening or backing out under adverse conditions such as vibration and elevated temperature. A suitable type of screw, for example, is a BosScrew™ available from ITW Shakeproof Industrial Products, of Broadview, Ill. A low-friction bushing or bearing 33 can be disposed between the hinge screw 34 and the hinge plate 30. The bearing 33 can comprises an annular ring of low-friction material, one non-exhaustive example of which is acetal (polyoxymethylene, or POM). Without the bearing 33, the shoulder of the hinge screw can rub on the hinge plate 30 and cause noise. The bearing 33 helps reduce such noise by providing a low-friction interface between the shoulder of the screw and the hinge plate.

In the illustrated embodiment, the hinge screws 34 also pass through apertures 29 (FIG. 6) in the leg members 26, 28. Each boss 40 has a side face 44 (FIG. 5) facing the respective leg member, and the leg member has a portion that abuts the side face 44 of the boss. This portion of the leg member is also abutted on its opposite surface by the head 36 of the hinge screw 34. More particularly, with reference to FIG. 6, the hinge screw has a stepped head that defines a smaller-diameter head portion 36*a* adjacent the threaded shank of the screw and a larger-diameter head portion 36*b* forming the end of the screw. The aperture 32 in the hinge plate 30 allows the smaller-diameter head portion 36*a* to pass through the aperture and abut the leg member 26 and thereby urge the leg member against the side face 44 of the boss 40. The bosses 40 thus provide lateral support to the leg members 26, 28, in addition to serving their primary function as the hinge support member for the door.

The connection between the hinge plates 30, leg members 26, 28, hinge screws 34, and bosses 40 is such that the hinge plates 30 are able to pivot about the pivot axis defined by the bores 42 in the bosses. More particularly, with reference to FIG. 6, the larger-diameter head portion 36*b* of the hinge screw is adjacent the outer surface of the hinge plate 30. The "offset" distance between the larger-diameter head portion 36*b* and the smaller-diameter head portion 36*a* is slightly larger than the thickness of the hinge plate 30. Accordingly, the hinge plate "floats" between the head portion 36*b* and the leg member 26. The aperture 32 in the hinge plate is slightly larger than the diameter of the smaller-diameter head portion 36*a*, and thus the hinge plate is able to pivot freely about the hinge screw.

The door 24, by virtue of its connection to the hinge plates 30, thus is able to pivot about the horizontal pivot axis defined by the hinge support member or bosses 40. The hinge plates 30 have portions forming counterbalance arms 50 that extend generally horizontally rearward and terminate in hooks 52 (FIGS. 4 and 5) to which extension springs (not shown) or the like are connected, the opposite ends of the springs being connected to lower frame members (such as the leg members 26, 28). The springs exert a force tending to resist opening of the door and assist closing of the door, in conventional fashion.

Figure 7:
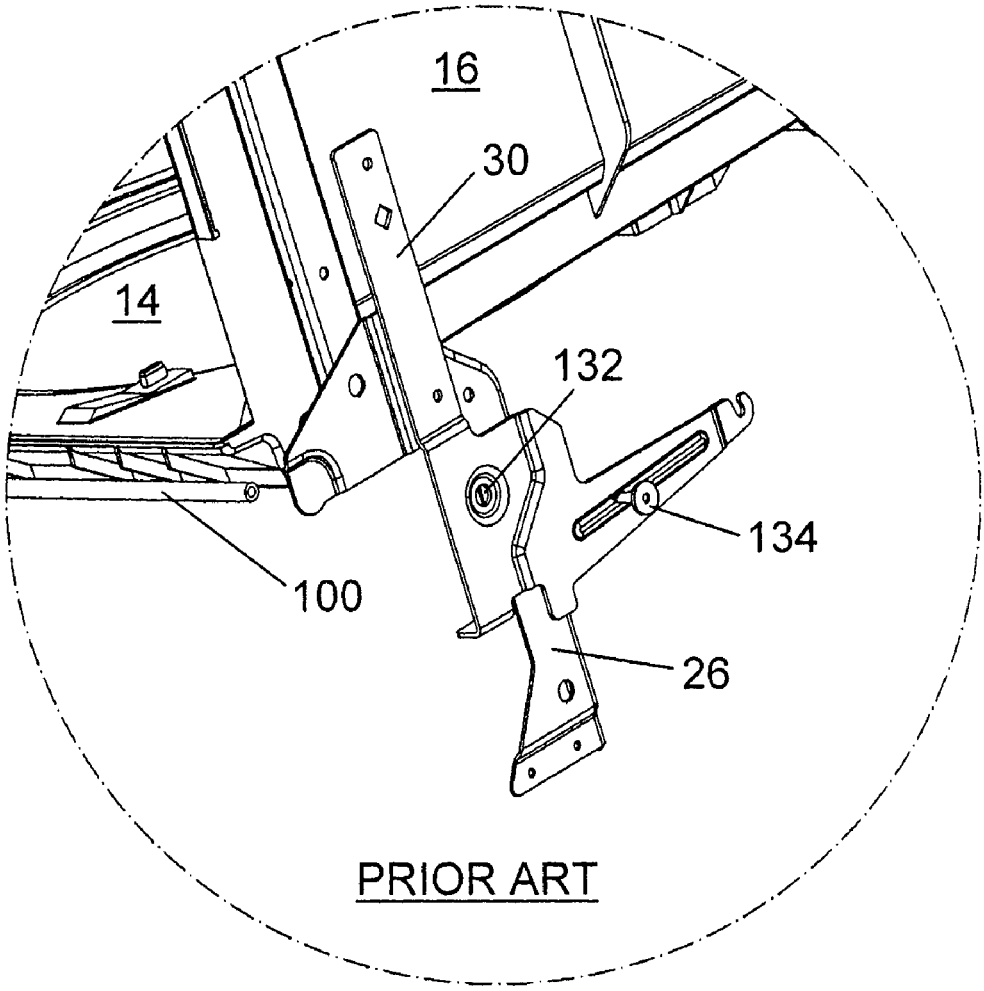
FIG. 7 is a view similar to FIG. 5, showing a prior-art hinge assembly.
Figure 8:
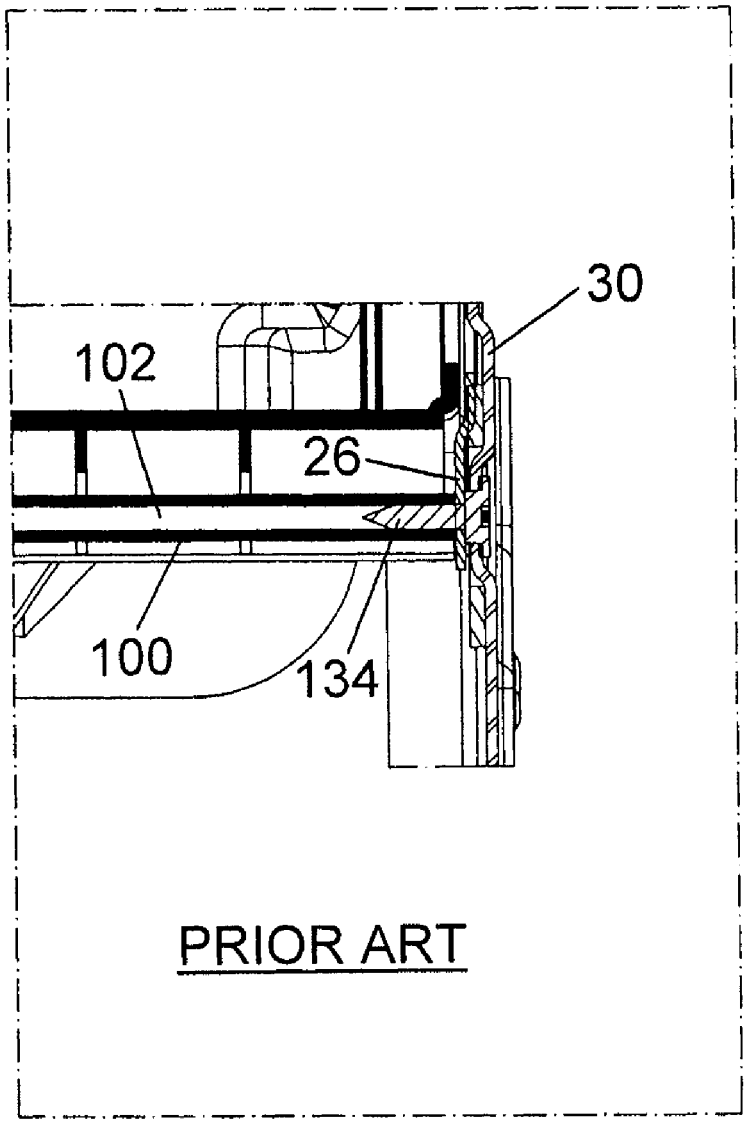
FIG. 8 is a cross-sectional view through the prior-art hinge assembly of FIG. 7.

FIGS. 7 and 8 depict a prior-art dishwasher hinge assembly, for comparison with the present invention. As shown, the prior-art hinge assembly includes a pair of hinge plates 30 (only one shown) affixed to opposite side edges of the door as in the above-described embodiment. A pair of leg members (only one leg member 26 shown in FIG. 7) are secured to the opposite side walls (only one side wall 16 shown in FIG. 7) of the tub. Hinge screws 134 (only one shown) pass through apertures 132 in the hinge plates, and through apertures (not shown) in the leg members. A hollow metal rod 100 extends the length of the front edge of the bottom wall 14 of the tub, and has an internal bore 102 that is open at the opposite ends of the rod. The hinge screws 134 are screwed into the opposite ends of the bore 102 in the rod 100, as best seen in FIG. 8. The hinge plates 30, and thus also the door, pivot about the hinge screws 134. The rod 100 is not affixed directly to the tub in any way, but rather is connected between the two leg members. Accordingly, the rod 100 plays no role in determining the position and orientation of the pivot axis for the door relative to the tub. Instead, the pivot axis is set by the leg members and more specifically by the apertures in the leg members in which the hinge screws 134 are engaged. As a consequence, the accuracy of positioning of the door's pivot axis is dependent on the accuracy of manufacturing of the leg members and their apertures, as well as accuracy of positioning of the leg members relative to the tub. Additionally, the portions of the leg members and hinge plates in alignment with the metal rod 100 are not laterally supported by any part of the tub, which can lead to door "wobble".

By contrast, in accordance with the invention, the door is essentially directly connected to the tub in a pivotal manner by virtue of the hinge support member. The hinge support member, being integrally molded with the tub, has precise dimensions and thus the pivot axis for the door is highly accurately located with respect to the tub. Additionally, the lateral positioning and vertical positioning of the door relative to the tub are established by the hinge support member or bosses 40 in a highly accurate manner. Although there can be expected to be manufacturing tolerances on the location, diameter, and roundness of the boss bores 42, the diameter and roundness of the smaller-diameter head portions 36*a* of the hinge screws, and the location, diameter, and roundness of the apertures 32 in the hinge plates, these tolerances are readily maintainable at quite small values. The bosses 40 also provide lateral support to the leg members and hinge plates. The invention thus can substantially reduce the degrees of freedom of the hinge plates 30, and therefore of the door, thereby reducing door "wobble", improving the fit and sealing between the door and tub, and providing a higher-quality "feel" to the door's action.

To provide enhanced rigidity to the bosses 40, each of them can define a plurality of ribs (not shown) extending generally parallel to the horizontal pivot axis for the door and spaced apart circumferentially relative to the pivot axis.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A dishwasher, comprising:

a tub comprising a molded plastic structure having a bottom wall joined to a plurality of vertical walls, and a top wall joined to upper ends of the vertical walls, so as to define a wash chamber, a front side of the tub defining an opening for access to the wash chamber, the bottom wall having a front edge;

a door for closing the opening in the front side of the tub, the door having a lower edge, two opposite side edges, and an upper edge;

a hinge support member integrally molded with the tub and located proximate the front edge of the bottom wall of the tub;

a pair of hinge plates respectively secured to the opposite side edges of the door and pivotally engaged with the hinge support member on the tub to enable the door to pivot relative to the tub about a horizontal pivot axis defined by the hinge support member; and a pair of leg members respectively secured to opposite side walls of the tub and extending downwardly from the tub for supporting the dishwasher on a support surface with the bottom wall of the tub spaced above the support surface;

wherein the hinge support member comprises a pair of bosses integrally molded with the tub and respectively located proximate opposite ends of the front edge of the bottom wall, a bore extending through a laterally outer side face of each boss, the bores establishing the horizontal pivot axis for the door, an elongate member for one of the hinge plates being inserted into the bore in one of the bosses, and an elongate member for the other hinge plate being inserted into the bore in the other boss, the leg members respectively abutting the laterally outer side faces of the bosses such that the side faces provide lateral support to the leg members; and wherein each of the bosses has a tubular portion that defines the bore and a plurality of spaced-apart webs connected between the tubular portion and the tub, and wherein the laterally outer side face of each boss is defined collectively by an end face of the tubular portion and end faces of the webs.

2. The dishwasher of claim 1, wherein each elongate member comprises a hinge screw that is screwed into the bore in the respective boss.

3. The dishwasher of claim 2, wherein the bores in the bosses are untapped prior to the hinge screws being screwed into the bores, and the hinge screws comprise self-tapping screws.

4. The dishwasher of claim 2, wherein each of the leg members defines an aperture through which the respective hinge screw extends.

5. The dishwasher of claim 4, wherein the hinge plates further define counterbalance arms.

6. The dishwasher of claim 4, wherein each hinge plate defines an aperture through which the respective hinge screw extends, each leg member having a portion disposed between the respective boss and a portion of the respective hinge plate, and wherein each hinge screw has an enlarged head that opposes a laterally outer surface of the respective hinge plate.

7. The dishwasher of claim 6, further comprising a low-friction bearing interposed between the enlarged head of each hinge screw and the respective hinge plate.

8. The dishwasher of claim 6, wherein the enlarged heads of the hinge screws are stepped, each defining a larger-diameter head portion and a smaller-diameter head portion, the larger-diameter head portions abutting the laterally outer surfaces of the hinge plates, the smaller-diameter head portions passing through the apertures in the hinge plates and abutting laterally outer surfaces of the leg members.

* * * * *